US009748712B2

(12) United States Patent
Guo et al.

(10) Patent No.: US 9,748,712 B2
(45) Date of Patent: Aug. 29, 2017

(54) ELECTRICAL CONNECTOR HAVING INSERTED INSULATOR AND METHOD OF MAKING THE SAME

(71) Applicant: FOXCONN INTERCONNECT TECHNOLOGY LIMITED, Grand Cayman (KY)

(72) Inventors: Jing-Jie Guo, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/196,490

(22) Filed: Jun. 29, 2016

(65) Prior Publication Data

US 2016/0380388 A1 Dec. 29, 2016

(30) Foreign Application Priority Data

Jun. 29, 2015 (CN) ..... 2015 1 0365307

(51) Int. Cl.

| | |
|---|---|
| ***H01R 13/648*** | (2006.01) |
| ***H01R 24/60*** | (2011.01) |
| *H01R 13/405* | (2006.01) |
| *H01R 12/50* | (2011.01) |
| *H01R 24/00* | (2011.01) |
| *H01R 12/72* | (2011.01) |

(52) U.S. Cl.

CPC ..... *H01R 24/60* (2013.01); *H01R 12/724* (2013.01); *H01R 13/405* (2013.01); *H01R 23/02* (2013.01); *H01R 23/7073* (2013.01)

(58) Field of Classification Search

None

See application file for complete search history.

(56) References Cited

U.S. PATENT DOCUMENTS

| | | | |
|---|---|---|---|
| 8,109,795 | B2 | 2/2012 | Lin et al. |
| 8,684,769 | B2 | 4/2014 | Kao et al. |

(Continued)

FOREIGN PATENT DOCUMENTS

| | | |
|---|---|---|
| CN | 203859329 | 10/2014 |
| CN | 204216260 | 3/2015 |
| TW | M500370 | 5/2015 |

*Primary Examiner* — Tho D Ta

(74) *Attorney, Agent, or Firm* — Wei Te Chung; Ming Chieh Chang

(57) ABSTRACT

An electrical connector includes an insulative housing, a number of first contacts and second contacts, an insulator inset-molded with the first contacts, a metallic shielding plate retained in the insulative housing, and a shielding shell attached to the insulative housing. The housing has a base portion defining a receiving cavity located at a back-end thereof and extending forwardly and a tongue portion extending forwardly from the base portion. The tongue portion defines a first surface carrying the first contacts and a second surface located oppositely and a number of terminal-receiving slots located at the first surface and the second surface and communicated with receiving cavity. The second contacts are inserted into terminal-receiving slots located at the second surface. The insulator is received in the receiving cavity to insert the first contacts into the terminal-receiving slots located at the first surface.

19 Claims, 10 Drawing Sheets

(56) References Cited

U.S. PATENT DOCUMENTS

| | | | | |
|---|---|---|---|---|
| 2016/0020560 | A1* | 1/2016 | Ju | H01R 24/78<br>439/607.05 |
| 2016/0020568 | A1* | 1/2016 | Ju | H01R 24/78<br>439/607.01 |

* cited by examiner

ELECTRICAL CONNECTOR HAVING INSERTED INSULATOR AND METHOD OF MAKING THE SAME

BACKGROUND OF THE INVENTION

1. Field of the Invention

The present invention relates to an electrical connector and a method of making the same.

2. Description of Related Art

Universal Serial Bus (USB) and USB connectors are well known in the art. China Patent No. 203859329 discloses a reversible electrical connector. The electrical connector includes a first module, a second module disposed with the first module, an inner shell, and an outer shell. The first module includes a first insulative body and insert-molded metal sheet and first contacts. The first insulative body has a tongue portion defining a first surface and a second surface disposed oppositely. The second surface is formed with a number of receiving slots. The second module includes a second insulative body and a number of second contacts molded in the second insulative body. The first contacts are exposed from the first surface of the tongue portion and the second contacts are received in the receiving slots and exposed from the second surface of the tongue portion. Taiwan Patent No. M500370 discloses a reversible electrical connector. The electrical connector includes a shell, a number of first and second contacts, an upper insulative body insert-molded with the first contacts, a metal sheet, a lower insulative body insert-molded with the second contacts, and a middle insulative body insert-molded with the metal sheet. The middle insulative body has a number of receiving slots exposed from an upper surface and a lower surface. The first contacts with the upper insulative body are assembled to an upper surface of the middle insulative body and the second contacts with the lower insulative body are assembled to a lower surface of the middle insulative body.

An improved electrical connector is desired.

SUMMARY OF THE INVENTION

Accordingly, the object of the present invention is to provide an electrical connector comprising: an insulative housing having a plurality of receiving slots located at a back-end thereof; a plurality of terminals carried by the insulative housing, the terminals having a plurality of soldering portions exposed from the insulative housing, each receiving slot being located between every two neighboring soldering portions to receive soldering material; a metallic shielding plate retained in the insulative housing; and a shielding shell attached to the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
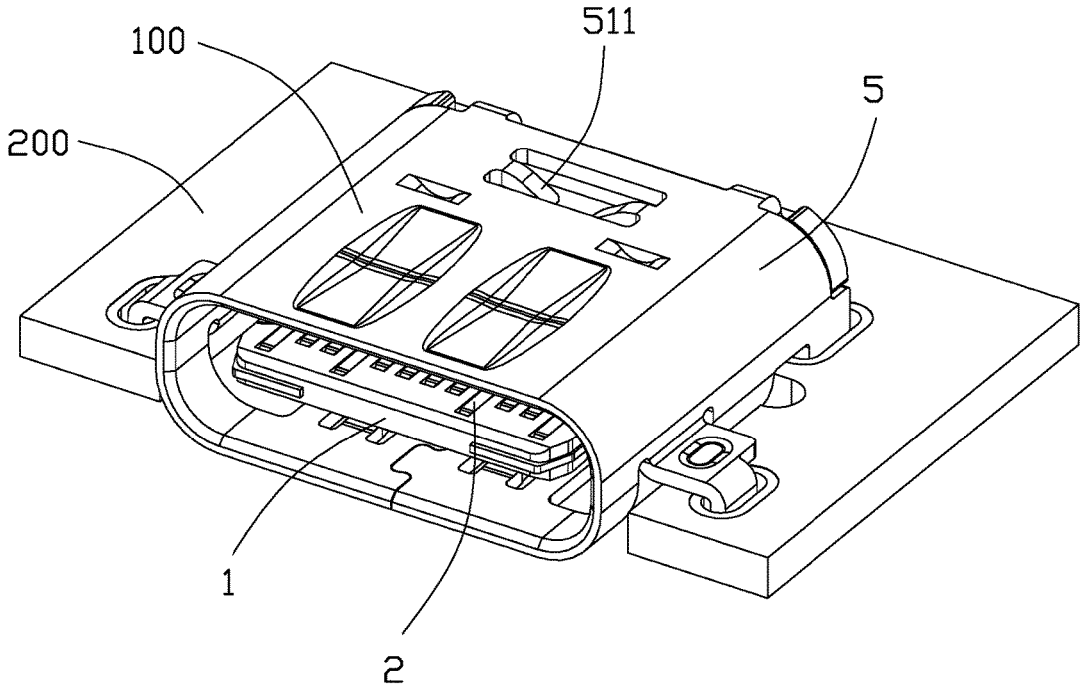
FIG. 1 is a perspective, assembled view of an electrical connector mounted on a printed circuit board.
Figure 2:
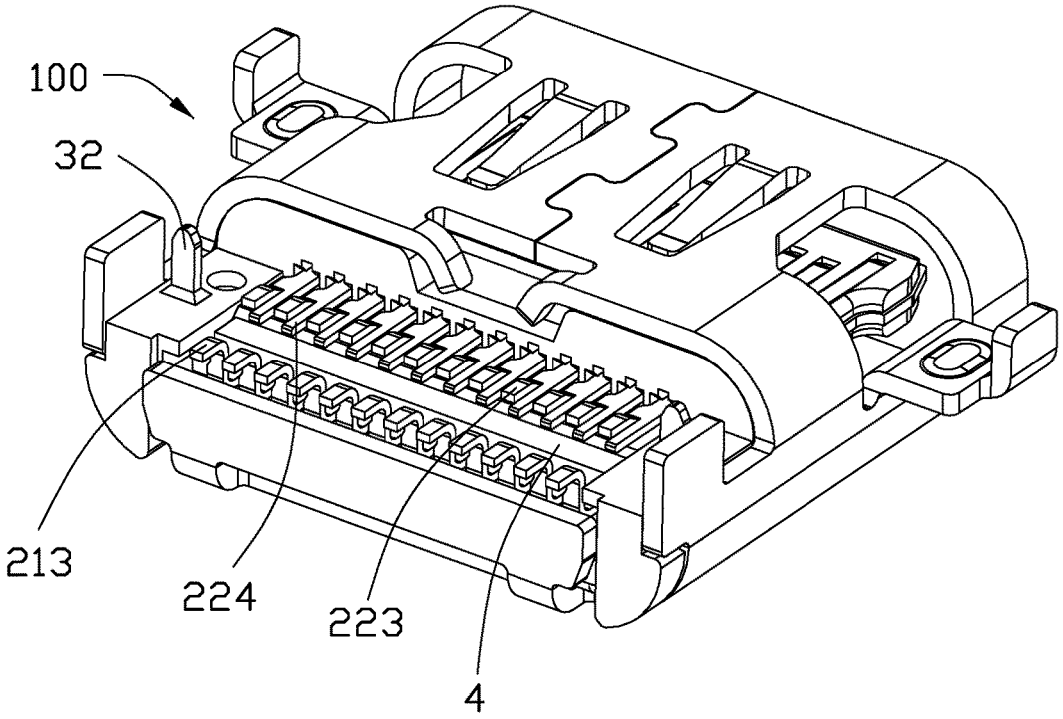
FIG. 2 is a perspective, assembled view of the electrical connector.
Figure 3:
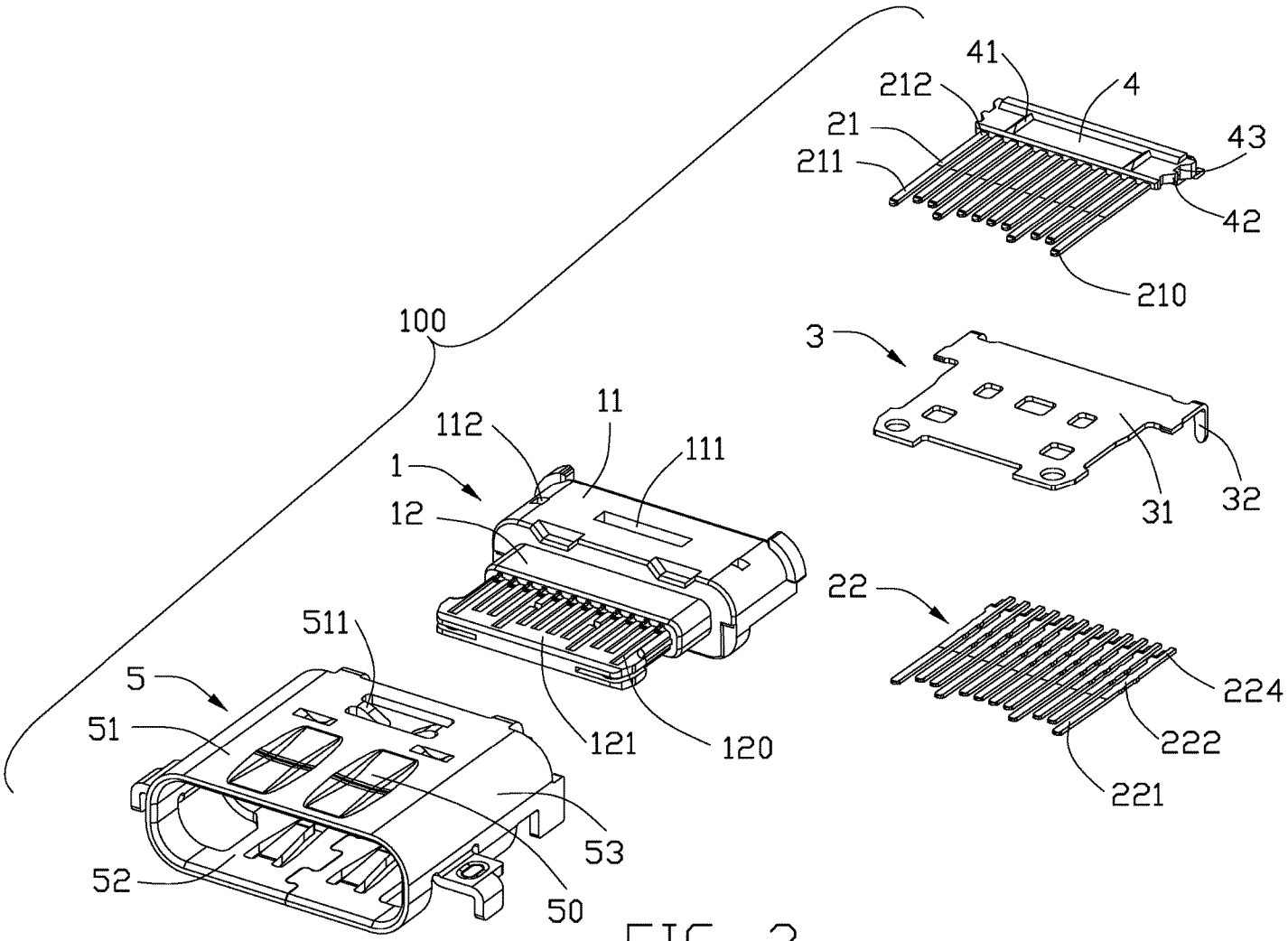
FIG. 3 is a perspective, partly exploded view of the electrical connector.
Figure 4:
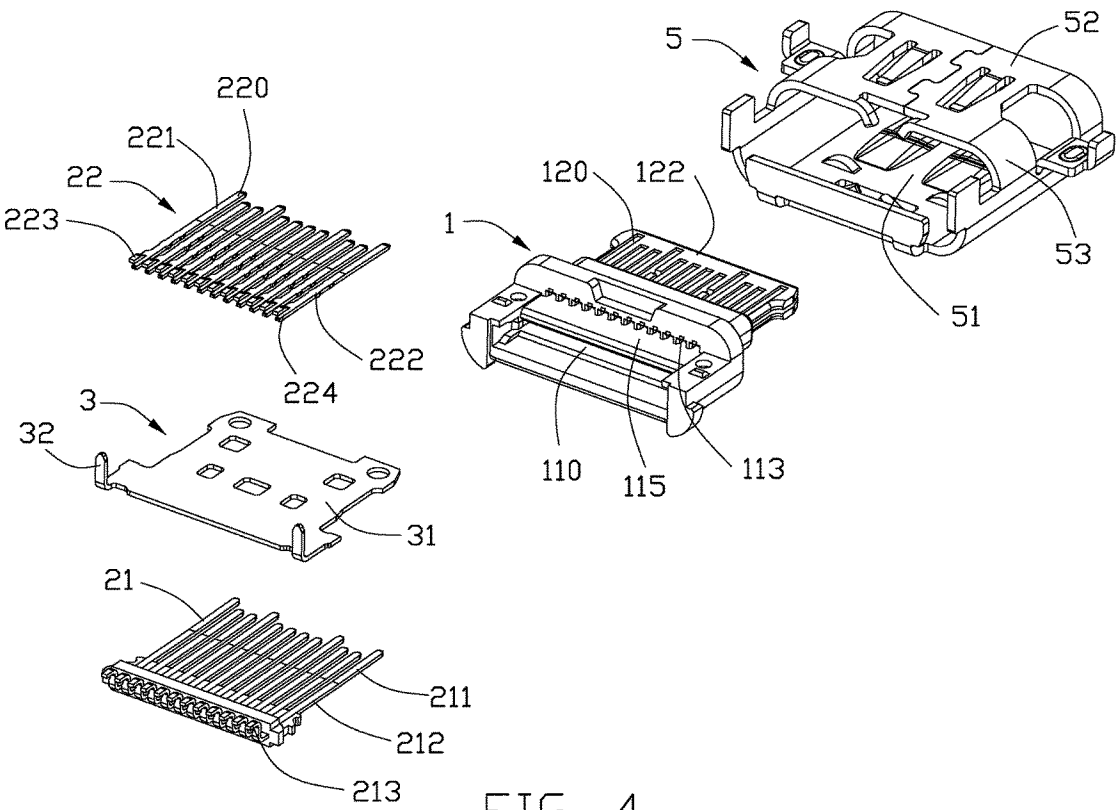
FIG. 4 is another perspective, partly exploded view of FIG. 3.
Figure 5:
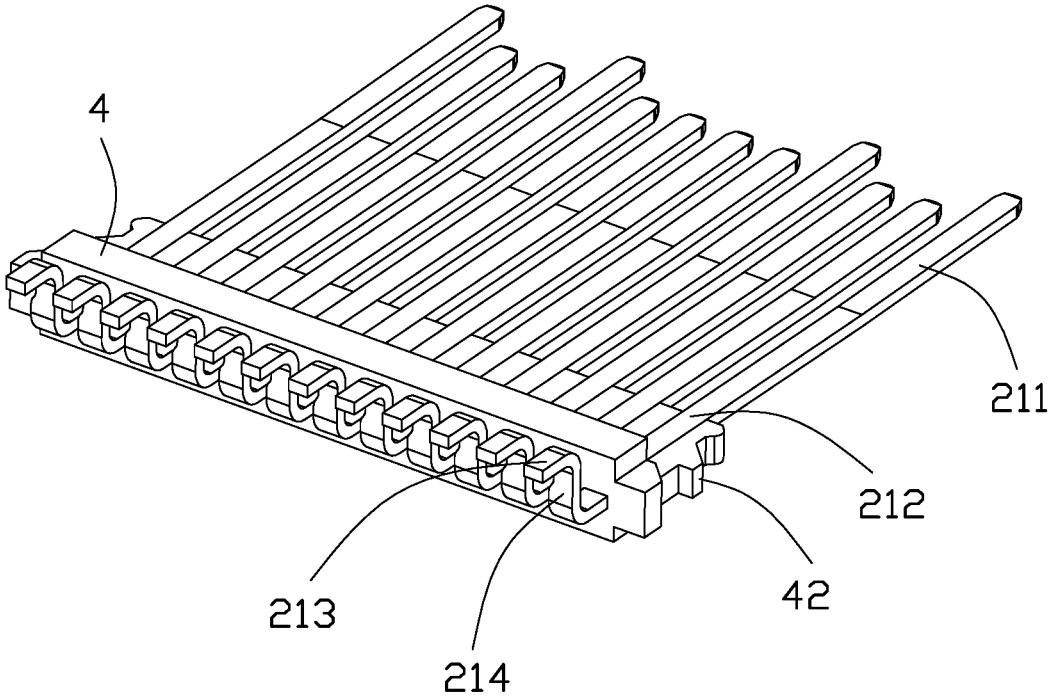
FIG. 5 is a perspective, assembled view showing a number of first contacts retained with an insulator of the electrical connector.

Reference will now be made in detail to the preferred embodiment of the present invention.

FIGS. 1-10 show an electrical connector 100 mounted upon a printed circuit board 200 and cooperated with a plug connector. For convenience, the electronic connector 100 defines a mating direction, a transverse direction perpendicular to the mating direction and forming a horizontal plane therebetween, and an up-and-down direction perpendicular to the mating direction and the transverse direction in FIG. 1.

The electrical connector 100 includes an insulative housing 1, a number of terminals 2 and a metallic shielding plate 3 retained in the insulative housing 1, an insulator 4, and a shielding shell 5 formed with a mating cavity.

Referring to FIGS. 3-8, the insulative housing 1 includes a base portion 11 and a tongue portion 12 extending forwardly from the base portion 11. The base portion 11 has an opening 111 located at an upper surface thereof, a pair of through-holes 112 located at two sides thereof and communicated with the upper surface and the lower surface, and an array of apertures 113 located at a rear end thereof. The base portion 11 has a receiving cavity 110 located under the apertures 113 to receive the insulator 4, a number of protrusions 114 extending to the receiving cavity 110, and a division portion 115 located between the apertures 113 and the receiving cavity 110. The tongue portion 12 defines a first surface 121 and a second surface 122, and a number of terminal-receiving slots 120 respectively located at the first surface 121 and the second surface 122 thereof and extending along the mating direction.

The terminals 2 include a number of first contacts 21 carried by the first surface 121 of the tongue portion 12 and a number of second contacts 22 carried by the second surface 122 of the tongue portion 12. Each of the first contacts 21 includes a first contacting portion 211 exposed from the first surface 121, a first affixed portion 212 extending along the mating direction, a first soldering portion 213 extending from a back end of the base portion 11, and a first connecting portion 214 bent downwardly from the first affixed portion 212. The first soldering portion 213 is lower than the first contacting portion 211 and the first affixed portion 212. The first contacts 21 are insert-molded with the insulator 4 and the first affixed portions 212 are retained in the insulator 4.

Figure 6:
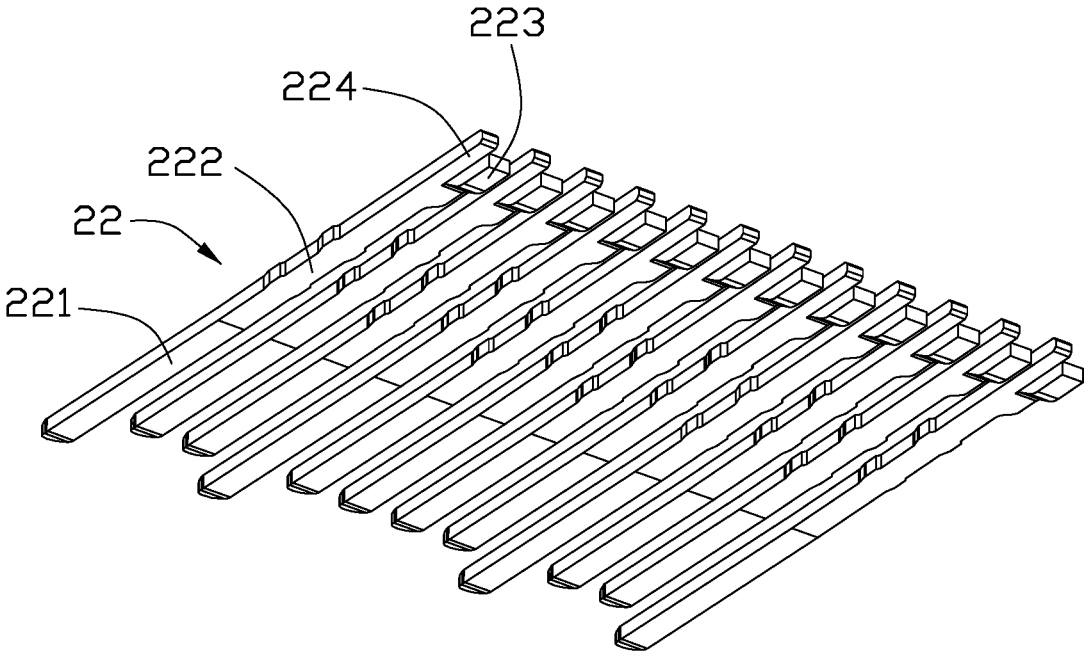
FIG. 6 is perspective view of a number of second contacts of the electrical connector.
Figure 7:
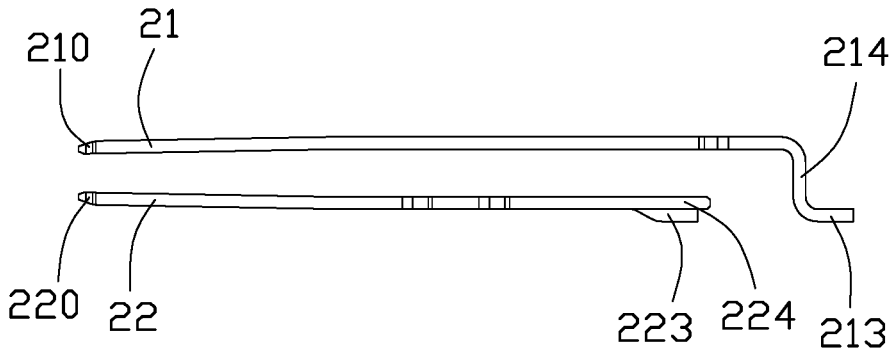
FIG. 7 is top perspective view of the first contacts and the second contacts.

Each of the second contacts 22 shaping like a panel, includes a second contacting portion 221 exposed from the second surface 122 of the tongue portion 12, a second affixed portion 222 retained in the tongue portion 12, and a second soldering portion 223 extending from a back end of the base portion 11. Referring to FIG. 6 and FIG. 7, each of the second contacts 22 has a tail portion 224 extending backwardly from the second affixed portion 222 and separated from the second soldering portion 223. In manufacture, the tail portions 224 are used for pressing and orienting and prevent interfering with the orienting and forming of the second soldering portions 223 in bending the second soldering portions 223. The second soldering portions 223 and the tail portions 224. Each of the first contacts 21 and the second contacts 22 respectively has an end portion 210,220 extending close to the metallic shielding plate 3 so that the terminals 2 are incapable of up-warping to scrape or null contact.

The first contacts 21 and the second contacts 22 are positioned to have 180 degree symmetry such that the corresponding plug connector can be inserted and operatively coupled to the electrical connector 100 in either of two orientations. The first contacts 21 and the second contacts 22 extend in the mating direction and respectively include four power contacts located forwardly and eight signal contacts located backwardly. The two power contacts in the middle are used to provide electric source and the other two are used for electrical grounding. The eight signal contacts include four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Referring to FIGS. 2-5, the metallic shielding plate 31 includes a supporting portion 31 retained in the tongue portion 12, and a pair of affixed legs 32 extending downwardly from the supporting portion 31.

Figure 8:
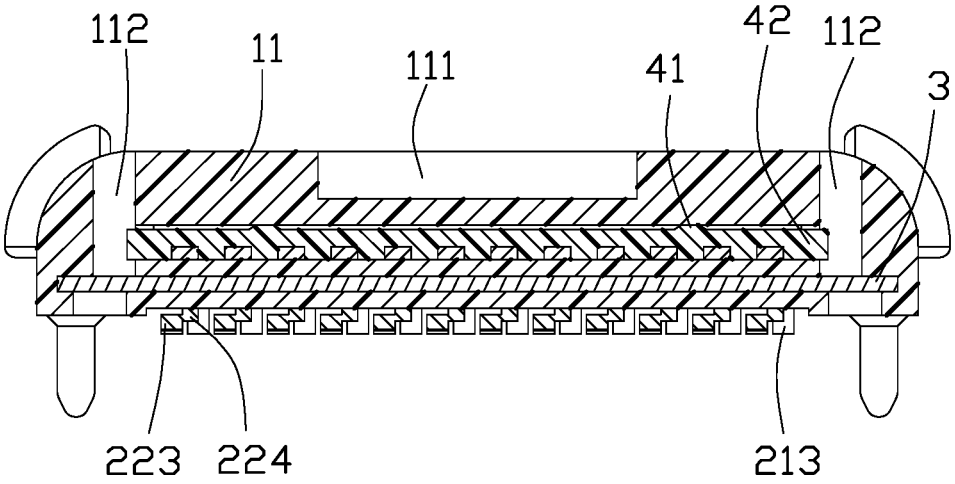
FIG. 8 is a cross-sectional view of the electrical connector with no shielding shell.
Figure 9:
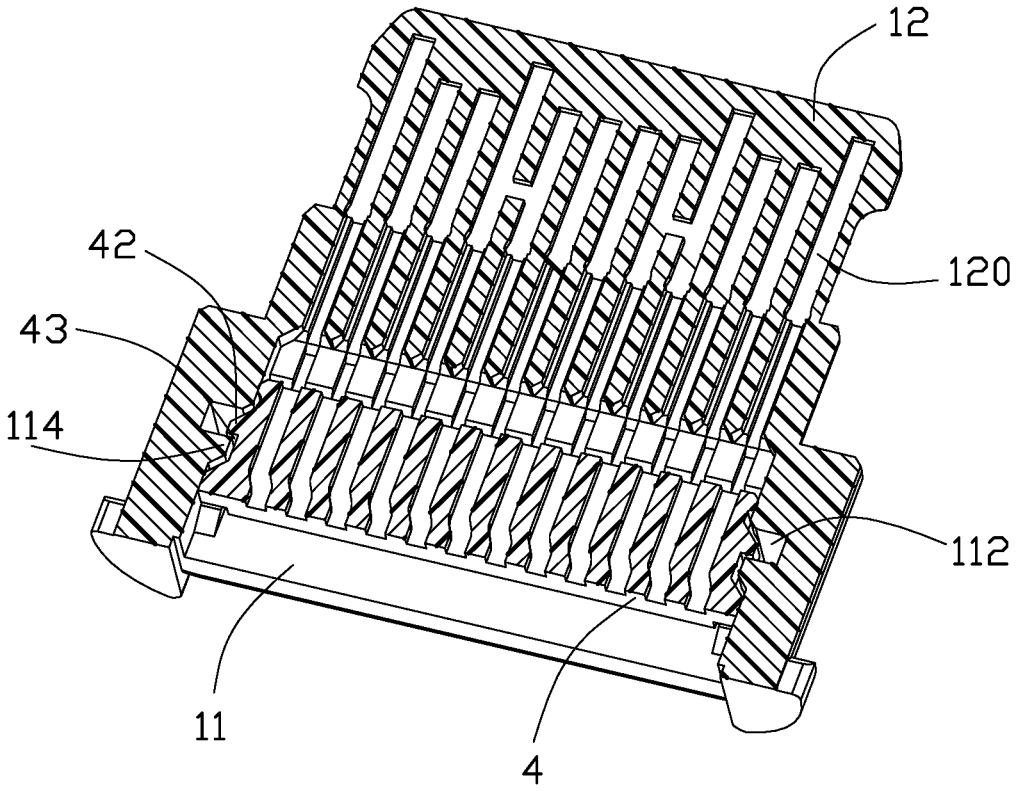
FIG. 9 is a cross-sectional view of an insulative housing assembled with the insulator.
Figure 10:
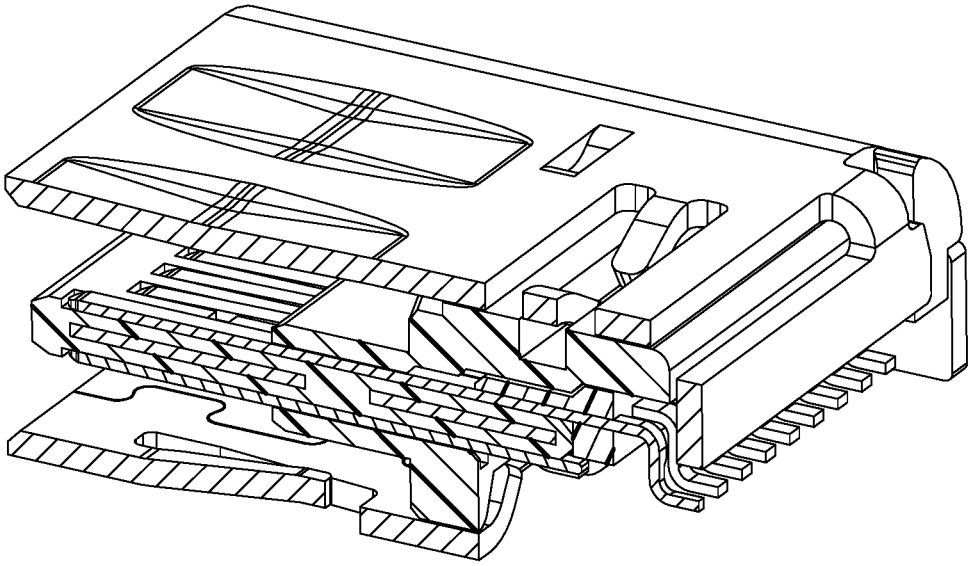
FIG. 10 is a partially cut-away perspective view of an insulative housing assembled with the insulator.

Referring to FIGS. 8-9, the insulator 4 has a number of ribs 41 resisting an inner surface of the receiving cavity 110 of the insulative housing 1 to affix the insulator 4 stably with the insulative housing 1. The insulator 4 has a number of projections 42 located at two sides thereof and a number of depressions 43 adjacent to the projections 42. The projections 42 protrude to the through-holes 112 of the insulative housing 1 and the protrusions 114 are received in the depressions 43 to orient the insulator 4 in the insulative housing 1 and prevent the insulator 4 withdrawing. The through-holes 112 are used to observe the assembly of the insulator 4 and the insulative housing 1.

Referring to FIGS. 1 to 5, the shielding shell 5 includes a top wall 51 and a bottom wall 52 located oppositely, and a pair of side walls 53 connected with the top wall 51 and the bottom wall 52. The top wall 51 has a number of dimples 54 protruding to an inner cavity to resist a shell of the mating connector to enhance grounding function and a pair of first clasping arms 511 bent downwardly from a rear end thereof and received in the opening 111 of the insulative housing 1.

The metallic shielding plate 3 is insert-molded with the insulative housing 1 and then the second contacts 22 are inserted into the terminal-receiving slots 120 of the second surface 122 of the insulative housing 1. The first contacts 21 insert-molded with the insulator 4 are inserted into the receiving cavity 110 to dispose the first contacts 21 into the first surface 121 of the insulative housing 1 and receive the projections 42 of the insulator 4 in the through-hole 112 of the insulative housing 1 to form a module. The shielding shell 5 is attached to the module at last. It has a lot of advantages to simplify the manufacture and the assembly to cost less. In this embodiment, the second soldering portion 223 is coplanar with the first soldering portion 213, and the tail portion 224 where the second soldering portions is split therefrom with a slight offset therebetween, is located at the same level of the second contacting portion 221. Understandably, this arrangement may preclude the second contacts 22 from being unified by another insulator for assembling due to the limited space in the housing. In opposite, the first contacts 21 are insert-molded by the insulator 4 before commonly inserted into the housing 1.

However, the disclosure is illustrative only, changes may be made in detail, especially in matter of shape, size, and arrangement of sections within the principles of the invention.

What is claimed is:

1. An electrical connector comprising:

an insulative housing having a base portion and a tongue portion extending forwardly from the base portion, the base portion defining a receiving cavity located at a back-end thereof and extending forwardly, the tongue portion defining a first surface and a second surface located oppositely and a plurality of terminal-receiving slots located at the first surface and the second surface and communicated with the receiving cavity;

an insulator insert-molded with a plurality of first contacts and received in the receiving cavity to insert the first contacts into the terminal-receiving slots located at the first surface of the tongue portion;

a plurality of second contacts inserted into the terminal-receiving slots located at the second surface of the tongue portion;

a metallic shielding plate retained in the insulative housing; and a shielding shell attached to the insulative housing;

wherein said insulative housing has an array of apertures, the apertures and the receiving cavity define a division portion therebetween, and the second contacts are exposed from a back end of the base portion through the apertures and located immediately under the division portion.

2. The electrical connector as claimed in claim 1, wherein said insulator has a plurality of ribs resisted against by an inner wall of the receiving cavity of the insulative housing.

3. The electrical connector as claimed in claim 1, wherein said base portion has a plurality of through-holes, and the insulator has a plurality of projections protruding into the through-holes.

4. The electrical connector as claimed in claim 3, wherein said insulative housing has a plurality of protrusions protruding into the receiving cavity, and the insulator has a plurality of depressions receiving the protrusions.

5. The electrical connector as claimed in claim 1, wherein each first contact has a first soldering portion extending backwardly from the insulator, and each second contact has a second soldering portion extending backwardly from the insulative housing, the first soldering portions and the second soldering portions being located in two rows in a same plane and offset along a transverse direction.

6. The electrical connector as claimed in claim 5, wherein each of the second contacts has a tail portion extending backwardly and separated from a corresponding second soldering portion to position the second contact.

7. The electrical connector as claimed in claim 5, wherein each of the first contacts and the second contacts has an end portion at a respective front end thereof, the end portions of the first contacts and the second contacts extending up to the metallic shielding plate.

8. An electrical connector assembly comprising:

a printed circuit board defining a notch;

an electrical connector located in said notch and including:

an insulative housing including a base portion and a tongue portion extending forwardly from the base portion in a front-to-back direction, said tongue portion forming opposite upper and lower surfaces in a vertical direction perpendicular to said front-to-back direction, a plurality of terminal receiving slots formed in each of said upper surface and said lower surface;

a metallic shielding plate embedded within the tongue portion via an insert-molding process;

a plurality of upper contacts unified by an insulator and forwardly inserted into the corresponding terminal receiving slots, respectively;

a plurality of lower contacts without any insulator associated therewith, forwardly inserted into the corresponding terminal receiving slots, respectively; and each of said upper contacts and said lower contacts including a front contacting section for mating with a plug connector, and a rear soldering section to be mounted upon the printed circuit board; wherein in the lower contact, the front contacting section is located at level slightly higher than that the rear soldering section is located at while in the upper contact, the front contact section is at a lever much higher than that the rear soldering section is located at, and the rear soldering sections of the lower contacts and those of the upper contacts are located at a same level.

9. The electrical connector assembly as claimed in claim 8, wherein the insulator is retained by the housing.

10. The electrical connector assembly as claimed in claim 9, wherein said housing forms an opening to inspect engagement between the housing and the insulator in the front-to-back direction.

11. The electrical connector assembly as claimed in claim 10, wherein said opening extends in the vertical direction.

12. The electrical connector assembly as claimed in claim 10, further including a metallic shell enclosing the housing and covering said opening.

13. The electrical connector assembly as claimed in claim 12, wherein said metallic shell includes a pair of front legs and a pair of rear legs mounting to the printed circuit board.

14. An electrical connector comprising:

an insulative housing having a base portion and a tongue portion extending forwardly from the base portion, the base portion defining a receiving cavity located at a back-end thereof and extending forwardly, the tongue portion defining a first surface and a second surface located oppositely and a plurality of terminal-receiving slots located at the first surface and the second surface and communicated with the receiving cavity;

an insulator insert-molded with a plurality of first contacts and received in the receiving cavity to insert the first contacts into the terminal-receiving slots located at the first surface of the tongue portion;

a plurality of second contacts inserted into the terminal-receiving slots located at the second surface of the tongue portion;

a metallic shielding plate retained in the insulative housing; and a shielding shell attached to the insulative housing;

wherein each first contact has a first soldering portion extending backwardly from the insulator, and each second contact has a second soldering portion extending backwardly from the insulative housing, the first soldering portions and the second soldering portions being located in two rows in a same plane and offset along a transverse direction.

15. The electrical connector as claimed in claim 14, wherein said insulator has a plurality of ribs resisted against by an inner wall of the receiving cavity of the insulative housing.

16. The electrical connector as claimed in claim 14, wherein each of the second contacts has a tail portion extending backwardly and separated from a corresponding second soldering portion to position the second contact.

17. The electrical connector as claimed in claim 14, wherein each of the first contacts and the second contacts has an end portion at a respective front end thereof, the end portions of the first contacts and the second contacts extending up to the metallic shielding plate.

18. The electrical connector as claimed in claim 14, wherein said base portion has a plurality of through-holes, and the insulator has a plurality of projections protruding into the through-holes.

19. The electrical connector as claimed in claim 18, wherein said insulative housing has a plurality of protrusions protruding into the receiving cavity, and the insulator has a plurality of depressions receiving the protrusions.

* * * * *